United States Patent [19]

Reese, deceased et al.

[11] 4,444,378

[45] Apr. 24, 1982

[54] APPARATUS FOR SEPARATING SLAG FROM A MOLTEN METAL

[76] Inventors: Thurston F. Reese, deceased, late of Duluth, Ga.; by Alma C. Reese, executrix; by John F. Reese, executor, both of 3324 McClure Bridge Rd., Duluth, Ga. 30136

[21] Appl. No.: 407,035

[22] Filed: Aug. 11, 1982

[51] Int. Cl.[3] ..... C21C 7/00; F27B 9/38

[52] U.S. Cl. ..... 266/237; 222/594; 266/240; 417/50

[58] Field of Search ..... 417/50; 222/594; 266/237, 234, 240; 164/147.1

[56] References Cited

U.S. PATENT DOCUMENTS 3,883,045 5/1975 Gerbig ..... 222/372

FOREIGN PATENT DOCUMENTS 2110401 3/1970 Fed. Rep. of Germany ..... 266/237

*Primary Examiner*—L. Dewayne Rutledge
*Assistant Examiner*—Christopher W. Brody
*Attorney, Agent, or Firm*—E. Thomas Wheelock

[57] ABSTRACT

Method and apparatus for separating iron or steel from slag by inductively pumping the iron or steel up an inclined trough away from the non-pumped slag.

14 Claims, 3 Drawing Figures

APPARATUS FOR SEPARATING SLAG FROM A MOLTEN METAL

BACKGROUND OF THE INVENTION

This invention relates to an improved method and apparatus for separating a molten metal from non- or weakly-magnetizable floating material. The invention has special applications to separating slag from molten steel or iron. In its most basic form the invention process entails inductively pumping a molten metal up from beneath a non- or weakly-magnetizable floating material, such as a slag, and up an incline away from the floating material.

One method used quite frequently in making alloy or carbon steels is the electric-arc process. Although the process suffers the liability of requiring relatively high purity scrap or pig iron, it possesses the advantages of low investment cost, flexibility in the wide range of steel composition which may be produced, and the capability of using only a portion of the capacity of the involved vessels.

Although many variations in the configuration of arc-furnaces exist, one of the most common is a modification of the arc furnace first constructed and operated by Sir William Siemens in the late 1870's. The furnace itself is usually cylindrical and has a shallow hemispherical bottom portion in which the molten metal ultimately resides. The entire furnace is lined with a refractory which is not susceptible to attack by the particular refining process which is to be carried out within. For instance, a furnace used for the basic process will often be lined with magnesite or, in appropriate areas, alumina. Furnaces for use with the acid process may use silica brick. Induction stirrers are sometimes installed beneath the furnace bottom to stir the molten metal and therefore attain a homogeneous product. The upper end of the furnace typically has three large electrodes which extend down to a point near the level of the metal charge. Three-phase electric current is applied to these electrodes. The current flow path is between the three electrodes through the molten metal bath. The cylindrical side walls have one or two doors which can be opened to either introduce the metal charge, slagging or alloying material into the furnace or to allow a human operator to rake slag from the surface of the molten metal. The furnace will also have a small tap-hole opening through the furnace wall with a long open runner on the outside of the wall which is used to decant molten metal from the furnace. There are also provision for tipping the whole arc furnace to decant the molten metal through the tap-hole, in a process step called "tapping", into a ladle for transportation and pouring elsewhere. It should be noted that the tap-hole is placed in a position on the furnace wall which, when the furnace is tapped, is below the surface of the molten metal and its floating slag. The intent of this placement is to allow production of a molten product which is only metal and has none of the slag included therein. It should be apparent that the purity of the molten metal at the end of the metal pour is highly dependent upon the skill of the person operating the arc-furnace. If that person is slow in observing that slag is exiting the furnace, the ultimate metal product may have slag inclusions within.

The operation of a typical arc-furnace begins with the introduction of the raw materials into the furnace. With the power to the arc electrodes off, a charge consisting of metal scrap, alloying constituents that are not easily oxidized, a recarburizer (often coke) and occasionally iron ore are added to the furnace through a side door. Power is then applied to the electrodes and they are brought down to a level close to the charge so as to form an arc. The charge is melted as quickly as is possible to optimize energy consumption. Because of the geometry of the electrodes with respect to the charge, the charge will quickly have a hole created in the relative center of the furnace. The resultant molten metal however quickly heats the lower lining in the furnace and begins melting the charge from the bottom. This combination of effects results in the charge becoming completely molten.

In the typical two-slag or basic process, a first slag forms from the charge and is continuously produced during the period the charge is melting. Silicon and manganese found in the charge react with oxygen and some iron to form a slag composed of complex manganese and iron silicates. Phosphorus, when present, is also oxidized and finds its way into the slag. Oxygen is sometimes injected to promote these reactions. The temperature of the metal bath is raised during the oxidation to advance the removal of excess carbon, as carbon monoxide, and to permit various inclusions to the metal-slag surface and into the slag. The formed carbon monoxide bubbles out of the metal bath as a "boil".

The first slag produced is normally removed and replaced with a reducing slag although a few variations of the basic arc-furnace process entail retaining the first slag and making it into a reducing slag by addition of appropriate materials. However, in the instance when the first slag is removed, the second slag is formed by adding materials such as silica sand, calcium fluoride (fluorspar), calcium oxide (burnt lime), and powdered coke. Excess phosphorus and sulfur appear in the slag and the oxygen level is reduced. Complex metal carbides, which sink to the metal-slag interface and contribute various alloying metals, may also be added at this point. Ideally, the metal bath is only kept under this slag for as short a time as is possible. When the composition of the bath is chemically correct, the furnace is tapped and the steel runs into a waiting ladle for transport and use elsewhere.

Another process using the arc-furnace which is gaining wide acceptance utilizes two vessels, i.e., the furnace and the ladle, to produce the same product in a manner which is more efficient when viewed from an equipment standpoint. In this two-vessel process, the arc-furnace is charged in the same way as in the basic arc-furnace process. An oxidizing slag is formed containing manganese and iron silicates. Excess carbon is oxidized and forms carbon monoxide in a "boil". However, rather than producing a second reducing slag in the arc-furnace, the molten metal is deslagged and transferred to a special ladle. The ladle is of a design which will allow the metal to be inductively stirred, permits the imposition of a vacuum on the metal, allows reheating the metal by removeable arc electrodes, and is tapped from the bottom during the teeming operation.

This ladle refining process (which has many variations) may include a vacuum degassing step to remove hydrogen and some oxygen, a heating step, and the addition of desulphurizing agents such as Misch metal or lime.

Proper use of the ladle during this later refining step has thus far shown good profitability even taking into account the higher initial capital expenditure for the equipment. The increased homogeneity and quality of the steel product and the increased productivity through the availability of the arc furnace during the period it had been used in the refining step have been the basic reasons. Because of the expense of the desulphurization additives placed in the ladle as described above, the clean separation of slag from the molten metal as it leaves the arc-furnace is especially critical in this process.

Regardless of the process used to make the steel, there exists the overriding requirement that the floating slag be effectively separated from the molten steel product. Slags are necessary and are produced even in the open-hearth and basic oxygen processes.

As was described above, one method commonly used to remove slag from electric-arc furnaces involves the arduous and labor-intensive method of using large rakes to skim the molten slag through doors in the arc-furnace wall. Some slag may remain in the furnace using this technique. The use of a small tap-hole below the metal bath surface has thereafter been relied upon to prevent extraneous slag from entering the ladle. Some metal product will remain in the arc-furnace and will be lost if the operator is cautious. If the operator is not cautious, some slag will end up in the ladle. Inclusions of slag in the product steel are highly detrimental to the product properties.

The invention described herein uses a linear inductor, in its preferred embodiment, to provide an effective skimming action and therefore separate slag from molten steel or iron or other metals or alloys.

The use of an electromagnetic linear inductor to pump molten metals is well known in this art.

Throughout history, gravity has been the prime mover in the transportation of molten metals. Materials which are capable of withstanding the tremendous heat associated with molten metals are not, as a rule, of sufficient strength and structural integrity to be used as pump parts. Inductive pumping, although relatively expensive from a cost and energy standpoint, is the winner by default over other mechanical and electrical methods.

Other examples of the use of inductive pumps for molten metal, none of which are relevant to the invention disclosed herein, are discussed below.

A patent to von Starck, U.S. Pat. No. 3,554,670, issued Jan. 12, 1971 discloses an inductive liquid metal conveyer which is capable of pumping metal up an ascending trough. The disclosure in von Starck indicates that the metal conveying trough operates much in the same way as a standard induction motor. However the motor's inductor is cut open along its longitudinal axis and placed beneath this trough. The inductor is said to therefore comprise a stack of slotted or toothed laminations and an electrical winding which is inserted in the slots of the laminations. The stack of laminations for the polyphase winding of the inductor is divided into a number of poles. The length of the poles in a longitudinal inductive direction is indicated by the pole pitch. The disclosure in von Starck avers that a problem existed in a constant conveying force throughout the length of the trough; specifically, that in the area of the last pole division of the inductor the molten metal has a tendency to stagnate and, effectively, dam itself up. The solution to this problem is said to entail the use of a trough having a smaller angle of ascent in the area of the uppermost pole division. The solution is said to achieve substantial complete constancy of the conveying force and the molten metals' conveying speed over the entire length of the trough. No mention is made by von Starck of slag nor any method of separating it from a molten metal.

Another method of using an inductive pump for molten metal is disclosed in U.S. Pat. No. 3,881,915, to Proler, issued May 6, 1975. The apparatus and methods found in Proler center around the concept of providing a substantially continuous moving molten metal stream and introducing into the molten metal stream a charge of metal or metallic oxide particles which are of similar composition to the molten metal stream and which can be magnetically attracted. A magnetic field is placed beneath the moving molten metal stream to draw those particulates beneath the stream to either reduce the oxide particles or melt the metallic particles. Proler utilizes an inductive pump to provide the molten metal stream within the disclosed apparatus. The invention, in a preferred embodiment, has two or more moving metal streams in association with a number of holding tanks. Molten metal is pumped up an incline from a first tank to a second tank. The metal is pumped up another trough back to another level in the first tank. Metal or metal oxide particles are introduced into the troughs and are drawn beneath the surfaces of the metal stream by electromagnetic forces. This arrangement is said to overcome the problems associated with directly recovering the metallic content found in metallic fines. Small metallic particles have a tendency to float on molten metal and are therefore very slow to dissolve in the melt.

Proler discloses the use of a slag outlet at column 11 beginning at line 20. However, Proler does not disclose the advisability of extending the inductor to the lowest point in the molten bath, nor does it disclose the advantages of using a trough having a semi-circular cross-section nor the effect of decreasing the distance between the inductor and the molten metal towards the upper end of the trough.

U.S. Pat. No. 3,980,284, to Shigihara et al., issued Sept. 14, 1976, discloses what is said to be an improvement in the use of an induction pump in intermittent molding processes. The apparatus described in that patent has a well-insulated and constantly heated container made of a refractory material which encloses a molten metal bath. Metal is removed from that container by an inductive pump drawing metal through the container wall from a point in the container. Shigihara continuously circulates molten metal through the pump during the period between molding steps. Thus, fresh molten metal is provided to the pump interior to keep it at a temperature above the solidus and prevent the metal in the less-insulated pump from freezing up.

Shigihara et al. does not teach a method of skimming slag.

U.S. Pat. No. 4,079.920 to Mischenko et al., issued Mar. 21, 1978, discloses the use of an inductive pump in a furnace. The inductive pump can be used either to stir an aluminum metal bath or deliver the molten metal to another processing step such as a continuous casting machine or injection molding machine. The furnace is constructed with an oblique wall extending from the floor at a shallow angle up to a metal discharging port through the furnace wall. The liquid level metal bath resides part way up the oblique wall. The inductor is placed beneath the oblique wall and, when the current is connected to flow in one direction, molten metal is pumped down the wall. However, since liquids are self-levelling in containers, the metal bath will flow around and tend to keep its level. The overall effect is merely to stir the metal. With the current connected to flow in the other direction, the inductive pump will move the metal up the oblique wall and out the discharge port.

Mischenko et al. does not teach a method of skimming slag.

SUMMARY OF THE INVENTION

The invention described herein relates both to a method for skimming slag from the surface of a molten metal by the use of an inductive pump and apparatus suitable for practicing that method. More particularly, the invention relates to apparatus which may be fitted to electric-arc furnaces for skimming slag from a molten steel or iron product as it leaves the furnace during tapping.

Central to this invention is the discovery that few fluxes or slags associated with metal refining can be pumped using an inductive pump. Most metals and alloys however can be so pumped. Each embodiment of the inventive skimmer includes an inclined trough having beneath it inductive pumping means. The trough may have any of a number of cross sections although a semicircular shape is desired. The trough has a decanting or skimming portion at its lower end. The decanting portion is a container which accepts a slag/metal mixture and has an overflow weir permitting slag to run off for collection and disposal.

In the most preferred embodiment of the invention, the skimmer is in combination with an electric arc-furnace. The skimmer is adapted to hang from the furnace and, during the period the furnace is tilted or "tapped", to maintain a relatively level position.

BRIEF DESCRIPTION OF THE DRAWINGS

The drawings show the most preferred embodiment of the invention in three views.

DESCRIPTION OF THE PREFERRED EMBODIMENTS

In its simplest configuration the inventive apparatus is comprised of a receiver with an overflow weir for slag and a trough asecending from the receiver adapted to pump molten metal from the receiver up the trough.

The receiver may be of any convenient shape as long as it is capable of receiving and holding a mixture of molten metal and slag. For that reason, the surfaces which come in contact with molten metal or slag should be of a suitable refractory and backed up by as necessary a framework and structural stiffeners. The volume of the receiver should be optimized for the metal-slag system treated so as to provide enough residence time for the formation of a relatively clean metal-slag interface. The overflow weir should be placed high in the receiver wall but above the point where the inductor first picks up the molten metal.

The trough is desirably made to be integral with the receiver. The inductor beneath the trough should be placed so that it is capable of pumping metal from the lowest part of the receiver. The trough may be covered. Although the trough cross-section may be of any shape, the most desirable is semicircular. The molten metal in the volume of the trough closest to the inductor will move at the greatest rate. The flow rate of the metal decreases as the distance from the inductor increases. The movement of the liquid metal produces a backwashing effect on the surface of the liquid in the receiver and has a tendency to push the slag away from the trough. The purity of the delivered metal is therefore enhanced by the shape of the trough.

The inductor itself can be one of those disclosed by, e.g., Proler or von Starck, supra. Both operate by providing a traveling magnetic field which tends to move the molten metal up the respective inclined troughs.

It should be apparent that this embodiment of the inventive skimmer is suitable for use with most metal/slag or metal/flux combinations although it is most desirably used in steel or iron making.

Figure 1:
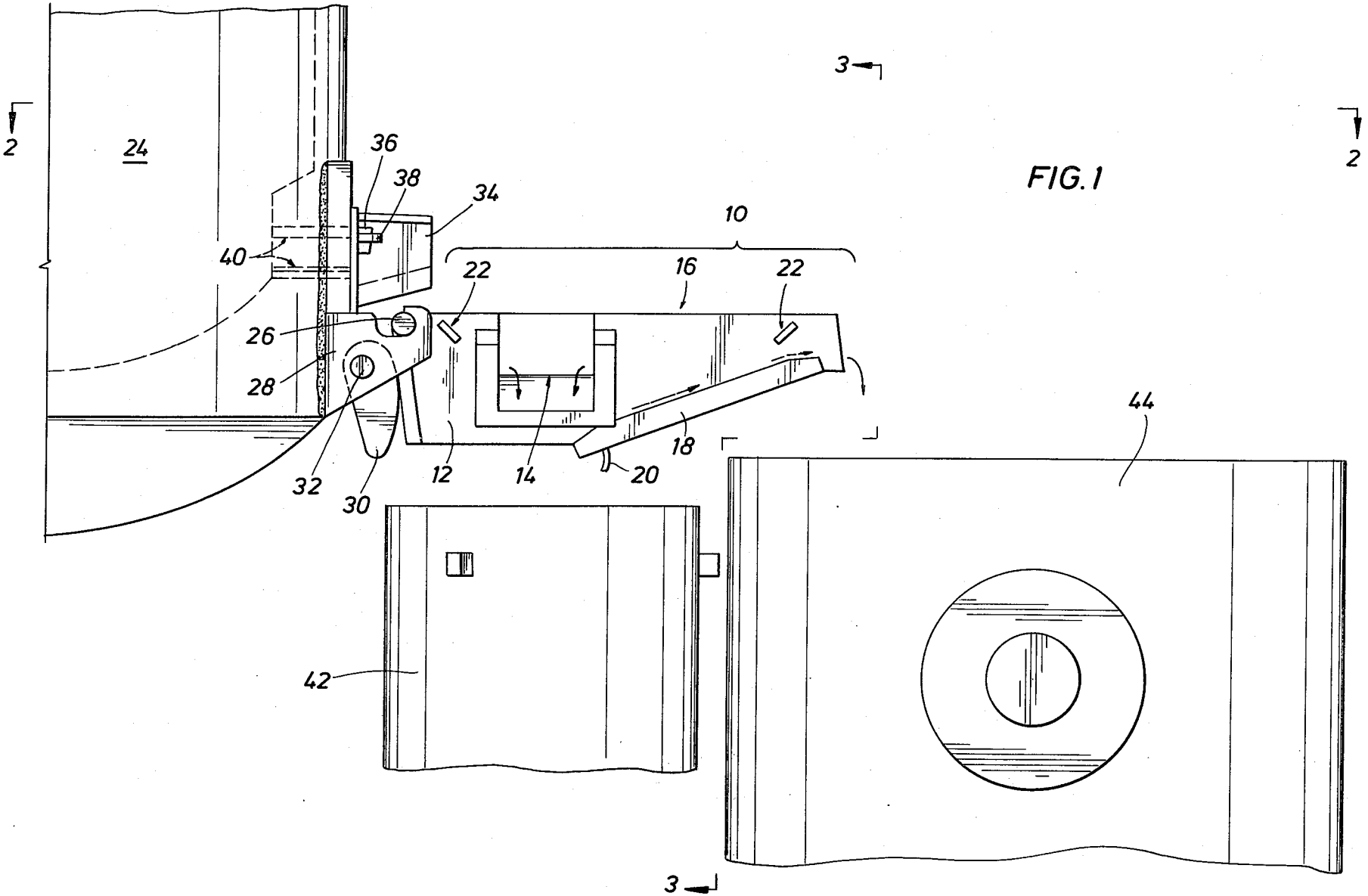
FIG. 1 shows, in side view, the inventive skimmer as hung from an electric arc-furnace, a receptacle for slag, and a ladle for receiving molten metal.
Figure 2:
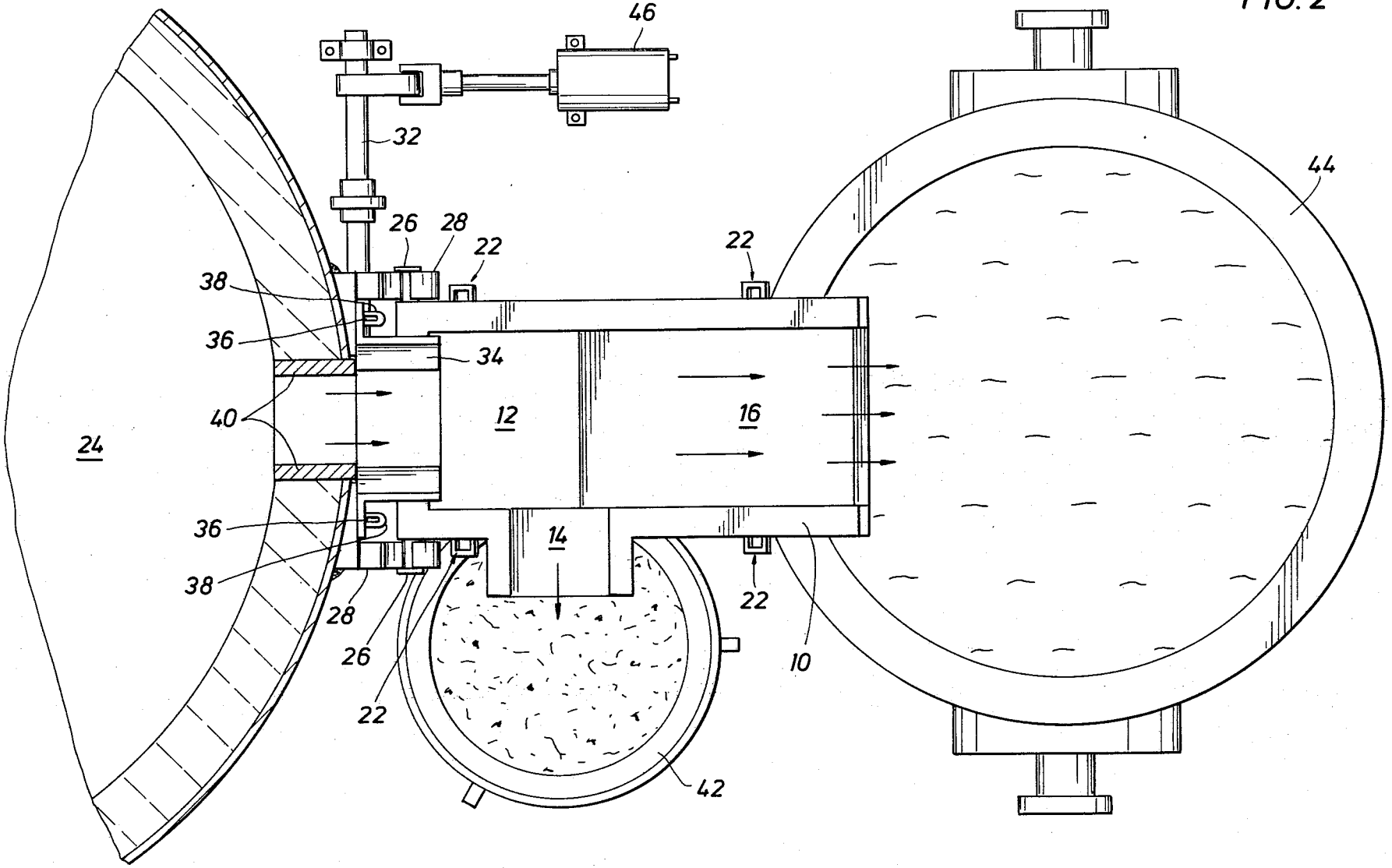
FIG. 2 shows the same configuration in top view but with the electric-arc furnace in partial section.
Figure 3:
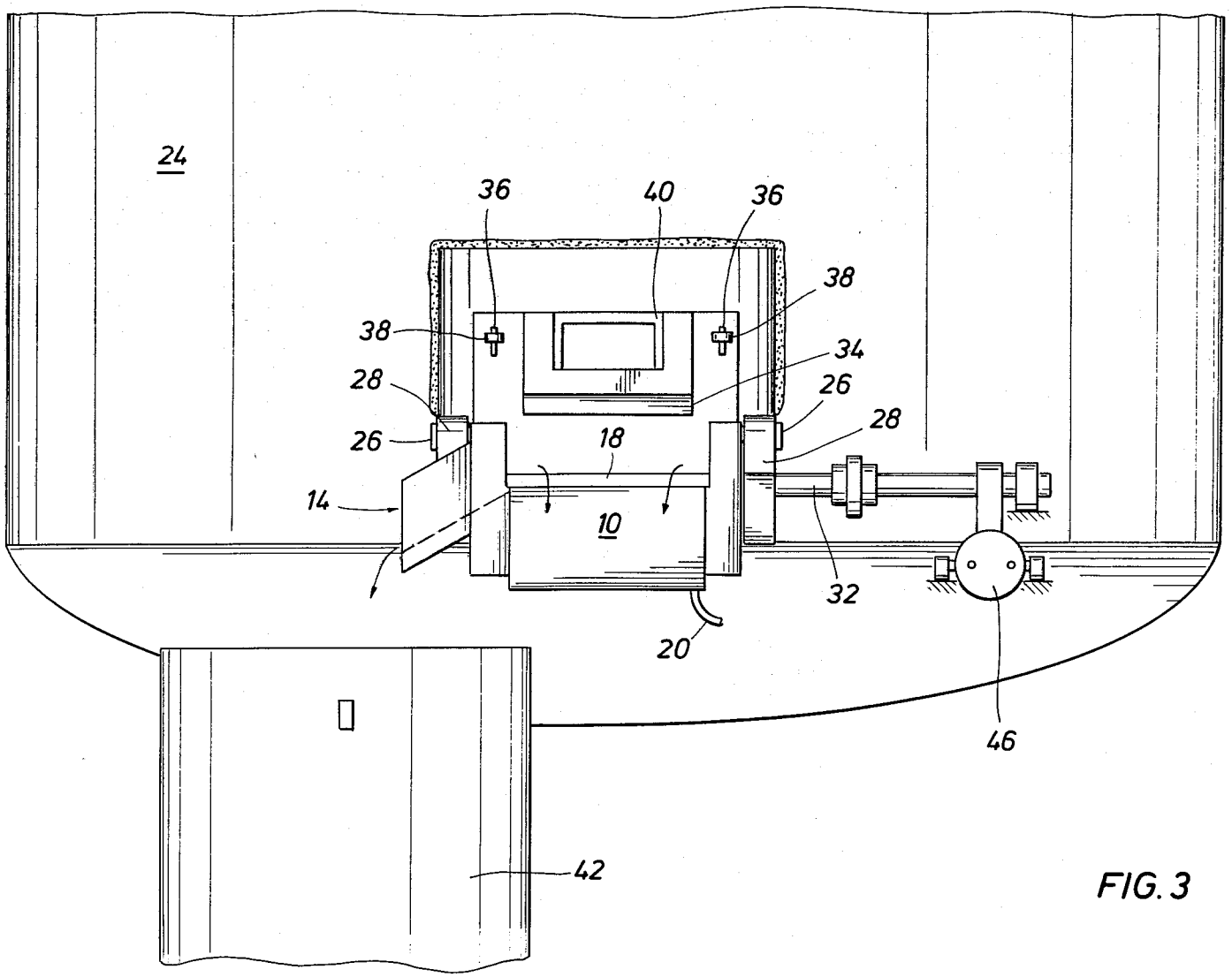
FIG. 3 shows the same configuration in end view but without the metal receiving ladle.

The most desirable embodiment of the invention is depicted in FIGS. 1 to 3.

As noted above in the Brief Description of the Drawings, the inventive apparatus is a combination of having a receiver with an overflow weir, an inductive pump beneath a trough, and an electric-arc furnace. Vessels for collecting molten metal and slag are also used although other means for transporting those two products are acceptable. The preferred apparatus also has means for maintaining the skimmer in a level position while the electric-arc furnace is tilted or "tapped".

In FIG. 1, skimmer assembly 10 is made up of a receiver portion 12, having an overflow weir 14, and a trough 16 having an inductor 18 comprising the traditional coils and laminations situated underneath. Although the trough 16 is schematically depicted as having a flat bottom, it is highly desirable to utilize one having a curved or semicircular bottom (as viewed in cross-section across the trough) for the reasons discussed above. It is also quite desirable to position the inductor 18 so that it initially picks up molten metal at the lowest portion of the receiver 12 and within the metal bath. There is a layer of refractory between the inductor and the molten metal. To prevent the pooling and self-damming at the top of the trough, as disclosed in von Starck, the refractory layer should be thinner at the top of the trough so as to impart more inductive force to the molten metal as it leaves the trough. Power to the inductive pump 18 is fed through power line 20. Lifting lugs 22 are depicted on the outside of trough 16 so that the skimmer assembly 10 may be lifted and detached from the electric-arc furnace 24. The skimmer assembly 10, in this embodiment, has an extended stub shaft 26 on each side of the skimmer assembly 10 around which the skimmer assembly 10 may rotate when the arc furnace 24 is tilted. The arc furnace would be tilted clockwise in FIG. 1. The two stub shafts 26 also support the skimmer assembly 10 on the arc-furnace 24 by use of support hooks 28.

In this embodiment of the invention, a cam 30 is placed between the skimmer assembly 10 and the outside wall of the arc furnace 24. The cam is turned about shaft 32 in such a manner that the overflow weir 14 remains substantially level as the arc furnace 24 is tipped to deliver a metal/slag mixture into the skimmer.

The arc-furnace 24 depicted in the FIGURES has been modified in comparison to those usually found in this industry. The runner 34 is quite short and, in this case, replaceable by removal of the interference pins 36 fitting through the eyes 38 placed on the outside of the arc furnace 24. The arc furnace 24 also has a removeable tap hole liner 40.

A receptacle for slag 42 is shown as well as a ladle 44 for the metal product. The runner on a typical arc furnace would extend out to ladle 44.

FIGS. 2 and 3 show the same apparatus from, respectively, the top and end views. The device used for rotating the shaft 32 and cam 30 is, in this case, a hydraulic cylinder 46 can be clearly seen.

Referring back to FIG. 1, the preferred embodiment operates in the following manner. After a mixture of metal and slag is produced in arc furnace 24, the arc furnace 24 is tipped by means not shown to pour a mixture of metal and slag through tap hole liner 40, over runner 34 and into the receiver 12 portion of the skimmer assembly 10. The cam 30 is simultaneously turned, by manual or automatic control, to maintain the overflow weir 14 in a substantially level position.

The inductor 18 is energized pumping metal from a low level in the receiver 12, up the incline, and out into ladle 44. As the arc furnace 24 is continuously tipped, the skimmer assembly 10 is continuously rotated to maintain the overflow weir 14 substantially level.

As the slag level builds up in receiver 12, it will finally run out through overflow weir 14 into slag receptacle 42.

When the arc furnace 24 is emptied, it is again raised to a level position. The remaining slag in the skimmer assembly 10 may be dumped, after moving the ladle 44, by turning the cam 30 clockwise from the position shown in FIG. 1.

Removal and replacement of the skimmer assembly 10 is a simple operation. The two interference pins 36 are removed from their respective eyes 38 and the runner 34 can then be slipped over the eyes 38 and pulled away from the outside wall of the arc furnace 24. The inductor power cable 20 can then be disconnected and the skimmer assembly 10 picked up by lifting lugs 22.

It should be understood that although the preferred embodiment is shown as a combination of the skimmer assembly and an electric-arc furnace, the invention is not so limited. The skimmer assembly may be mounted on the floor, as on a slag receptable, or on a ladle. Other means for maintaining the spatial relationship between the runner and the receiver, such as Watts' linkages, are just as suitable as the disclosed cam. Use of the skimmer is not, of course, limited to steels made by the electric-arc furnace method. Steel-slag mixtures from open hearth or basic oxygen furnaces may be introduced into the skimmer by obvious means.

The foregoing disclosures and description of the invention are only illustrative and explanatory. Various changes in the size, shape, and materials of construction, as well as in the details of the illustrated construction and operation, may be made within the scope of the appended claims without departing from the spirit of the invention.

What is claimed is:

1. An apparatus suitable for separating a molten metal from a non- or weakly-magnetizable material floating on said molten metal supported by a container suitable for melting or refining solid metals and producing a molten metal and delivering said molten metal by tilting comprising:

a receiver having sides, a bottom, and an open upper end and adapted to receive a mixture of said molten metal and non- or weakly-magnetizable material, having an overflow weir at a level below the open upper end on at least one side and adapted to maintain said overflow weir in a substantially horizontal position as said container is tilted; and a trough having a lower end at the lowest point in the receiver and ascending to a discharge point above the level of the overflow weir and having an inductor positioned beneath said trough to inductively pump molten metal up a flow path in said trough and out said discharge point, whereby molten metal may be pumped from the receiver and up the trough and said non- or weakly-magnetizable material may overflow the overflow weir.

2. The apparatus of claim 1 wherein the trough has a curved crosssection perpendicular to said flow path of the molten metal up said trough.

3. The apparatus of claim 1 wherein the inductor is positioned beneath said trough so that said molten metal is initially pumped from the bottom of the receiver.

4. The apparatus of claim 1, 2, or 3 wherein the inductor is positioned beneath said trough so that the inductor is closer to the flow path at the discharge point than at the lower end of said trough.

5. The apparatus of claim 1 wherein the trough is integral with the receiver.

6. An apparatus suitable for separating a molten metal from a floating slag comprising:

a container adapted to melt and refine solid metals and produce a molten metal bath having slag floating thereon and adapted to tilt and pour both molten metal and slag through a tap-hole, a receiver supported by said container and having sides, a bottom and an open upper end adapted to receive said molten metal and slag from said container when said container is tilted, having an overflow weir on at least one side at a level below the open upper end, and is adapted to maintain said overflow weir in a substantially horizontal position when said container is tilted, and a trough having a lower end below the level of the overflow weir, an upper end above the level of the overflow weir, and having an inductor positioned beneath said trough so as to inductively pump molten metal up a flow path in said trough and out said upper end, whereby molten metal may be pumped from the receiver, up the trough, and out the upper end and said slag may overflow the overflow weir.

7. The apparatus of claim 6 wherein the container adapted to melt and refine metals is an electric-arc furnace.

8. The apparatus of claim 7 wherein the receptacle is integral with the trough.

9. The apparatus of claim 8 wherein the receptacle is pivotably and detachably attached to said electric-arc furnace in such a position that the molten metal bath having slag floating thereon is discharged into said receptacle.

10. The apparatus of claim 6 wherein the trough has a curved crosssection perpendicular to said flow path.

11. The apparatus of claim 6 wherein the inductor is positioned beneath said trough so that said molten metal is initially pumped from the bottom of the receiver.

12. The apparatus of claim 6, 10, or 11 wherein the inductor is positioned beneath said trough so that said inductor is closer to the trough at the discharge end than at the lower end of said trough.

13. The apparatus of claim 1 wherein the receiver is detachable from the container.

14. The apparatus of claim 6 wherein the receiver is detachable from the container.

* * * * *